US006062432A

United States Patent [19]

Estrada

[11] Patent Number: 6,062,432

[45] **Date of Patent: *May 16, 2000**

[54] LATCHING AEROSOL CAP

[76] Inventor: Juan Jose Hugo Ceja Estrada, Aquiles Sertan 123 Sur, 8000, Culiacan, Sinaloa, Mexico

[ * ] Notice: This patent issued on a continued prosecution application filed under 37 CFR 1.53(d), and is subject to the twenty year patent term provisions of 35 U.S.C. 154(a)(2).

[21] Appl. No.: 08/593,447

[22] Filed: Jan. 29, 1996

[51] Int. Cl.[7] ..... B67D 5/06

[52] U.S. Cl. ..... 222/153.12; 222/182; 222/402.14

[58] Field of Search ..... 222/153.12, 182, 222/402.13, 402.14, 402.15

[56] References Cited

U.S. PATENT DOCUMENTS

| | | | |
|---|---|---|---|
| 3,252,626 | 5/1966 | Belka | 222/402.14 X |
| 3,756,472 | 9/1973 | Vos | 222/189 |
| 3,837,537 | 9/1974 | Baldwin | 222/153 |
| 4,013,231 | 3/1977 | Van Veldhoven | 239/579 |
| 4,195,756 | 4/1980 | Campbell | 222/182 |
| 4,440,325 | 4/1984 | Treuhaft et al. | 222/153.12 X |
| 4,895,280 | 1/1990 | Tourigny | 222/402.13 |
| 4,925,107 | 5/1990 | Brown | 239/414 |
| 4,941,600 | 7/1990 | Berriochoa et al. | 222/402.14 X |
| 5,503,303 | 4/1996 | LaWare et al. | 222/153.12 |

FOREIGN PATENT DOCUMENTS

| | | | |
|---|---|---|---|
| 0982526 | 1/1976 | Canada | 222/153.12 |

*Primary Examiner*—Joseph A. Kaufman
*Attorney, Agent, or Firm*—Donald J. Lenkszus

[57] ABSTRACT

An aerosol container cap assembly includes an actuating lever which is movable between first and second positions. A momentary depression of the lever will latch the container valve open so that the contents are discharged. A second momentary depression of the lever unlatches the valve to allow the valve to close.

12 Claims, 3 Drawing Sheets

LATCHING AEROSOL CAP

BACKGROUND OF THE INVENTION

This invention pertains to aerosol can cap assemblies and more particularly to an aerosol can cap which provides a latching function such that the can nozzle is maintained in a discharge position without continued depression of an activating button.

Aerosol cans are widely used to spray a wide variety of substances such as paint, lacquer, deodorants, lubricants and other materials. Widely used are aerosol cans which have a depress type actuator valve. An actuator button which typically incorporates a nozzle for dispensing a spray or mist is used to manually operate the valve to dispense the can contents. In some instances where it may be desirable to provide a stream discharge and to be able to accurately direct the target for the stream, a tubular straw is inserted into the nozzle which is integrally formed in the button.

The actuator button engages the depress valve which is biased to a closed position by a spring. Assuming that the aerosol can is in an upright position, with the actuator button on top of the can, the valve is ordinarily urged open by depressing the actuator button. Ordinarily the button is actuated by a human finger. As long as the finger depresses the actuator button, the contents of the can will be discharged. However, for certain products it is desirable to discharge the entire contents of the can or to at least discharge the can for an extended period of time. In those instances, it is highly desirable to provide for a locking arrangement whereby it is not necessary to depress an actuator button for the entire time that the contents will be discharged.

Various arrangements to provide aerosol locking devices have been provided in the past. U.S. Pat. No. 4,195,756 describes various latching or locking arrangements which will latch the aerosol valve in the open position. Each of the devices described in the '756 patent including the invention disclosed therein has particular disadvantages. Many of the locking arrangements are more appropriate to the discharge of a mist or vapor from a container to fill a room, such as for a fumigant. None of the prior arrangements as described in the '756 patent provide for easy unlocking to provide precise control of discharge of the contents of an aerosol can.

The present invention is particularly well adapted to use with aerosol cans of the type utilizing a depress type actuator valve. The present invention may be adapted to function with aerosol cans having a conventional actuator button or aerosol cans having a stream forming tube inserted into the button. The cap of the present invention may be used with existing spray cans.

It is an object of the invention to provide a simple and inexpensive cap for use with an aerosol container to allow continuous discharge of the contents of the container.

It is a further object of the invention to provide an easily operable latching actuator assembly for aerosol cans.

These and other objects of the invention will become apparent from a reading of the descriptions of the illustrative embodiments of the invention as described below.

SUMMARY OF THE INVENTION

The present invention is an aerosol container cap which permits the depress type actuator valve of the spray can to be easily locked in the open position. The cap of the present invention also permits unlocking of the valve from the open to the closed position to be easily achieved.

A single momentary downward push of an actuator lever latches the actuator valve open. A second momentary downward push and release of the actuator lever closes the valve.

In accordance with the present invention, an aerosol container cap for use with an aerosol container having a depressed type actuator valve includes a cap element and a latching portion.

The cap element has a tubular lower portion which terminates in a skirt portion which is shaped and dimensioned to releasably engage the top of the aerosol container. An upper cap portion closing off the upper end of the cap element includes an integrally formed push button actuator. The push button actuator is hinged to the cap. Extending downward of the actuator is the lock portion.

The latching portion includes a spring loaded global actuator pin and a locking mechanism which cooperates such that when the pin is pushed down a first time it becomes locked in the lower position. When the global actuator pin is pushed down a second time, the locking mechanism releases and the pin returns to a second higher position. In the first or upper position of the actuator valve, the valve is closed and therefore no discharge of the container contents occurs. In the second or locked lower position, the actuator valve of the spray can is locked in the open position to discharge the contents of the container.

BRIEF DESCRIPTION OF THE DRAWING

The invention will be better understood from the following detailed description of embodiments of the invention in which like reference numerals are used to designate like elements and in which.

DETAILED DESCRIPTION

Figure 1:
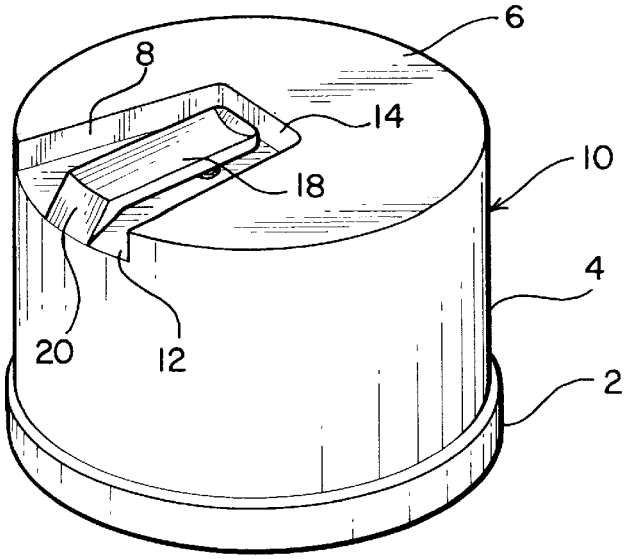
FIG. 1 is a perspective view of a aerosol can cap in accordance with the invention.
Figure 2:
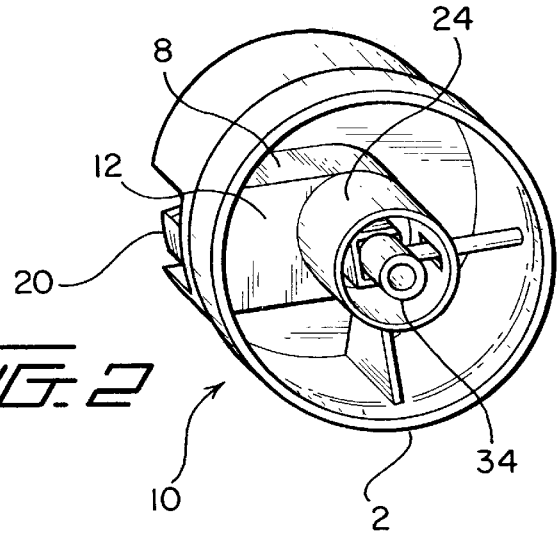
FIG. 2 is a bottom perspective view of the cap of FIG. 1.
Figure 3:
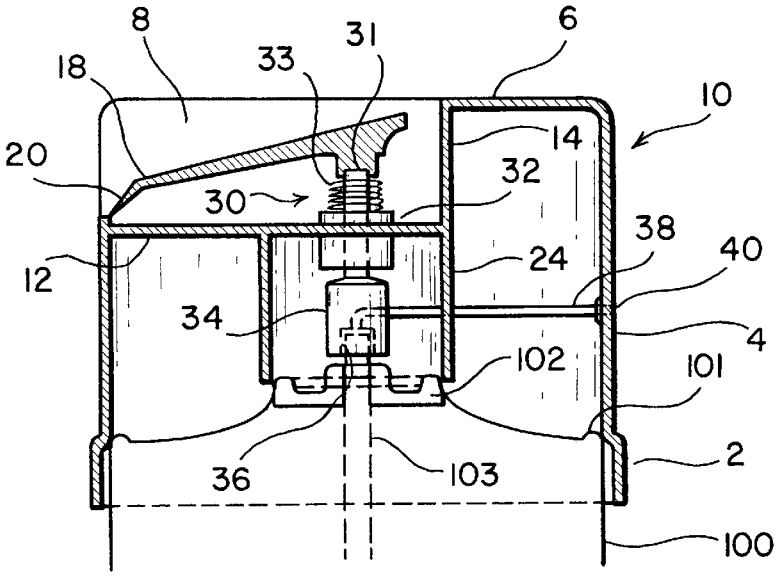
FIG. 3 is a cross-sectional side view of the cap of FIG. 1 disposed upon an aerosol can.
Figure 4:
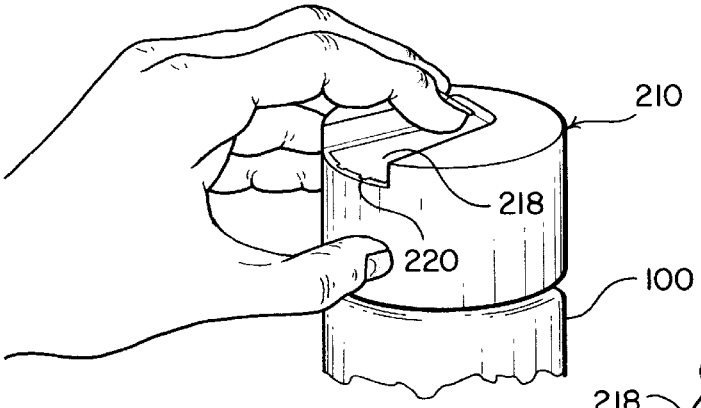
FIG. 4 is a perspective view of a second embodiment of an aerosol can in accordance with the invention.
Figure 5:
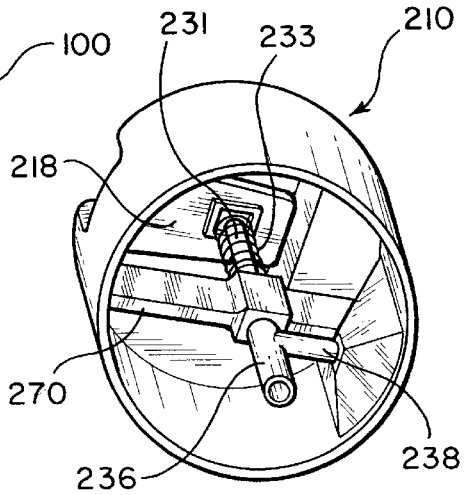
FIG. 5 is a bottom perspective view of the cap of FIG. 4.
Figure 6:
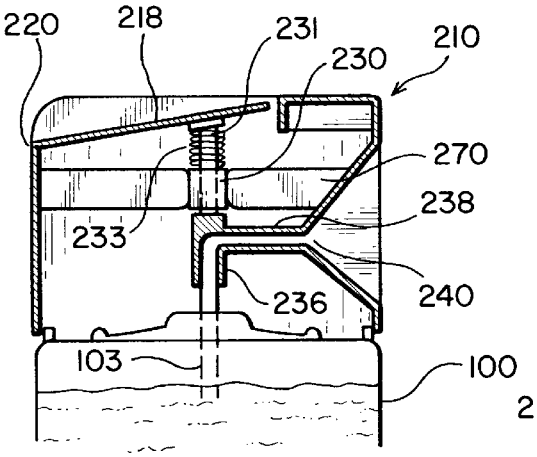
FIG. 6 is a cross sectional side view of the cap of FIG. 4.
Figure 7:
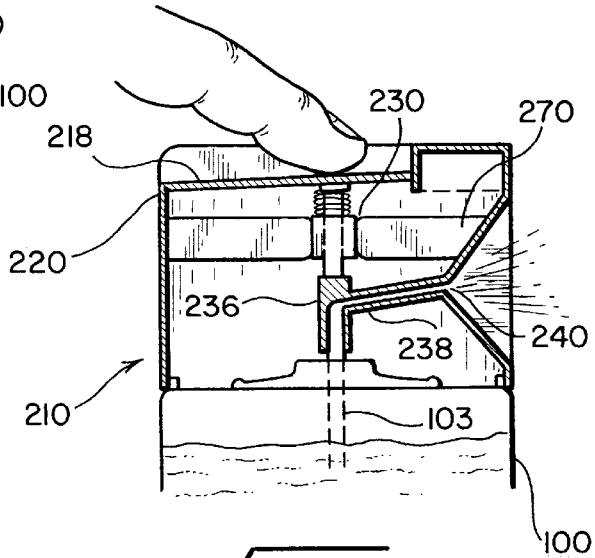
FIG. 7 is a cross sectional side view of the cap of FIG. 4 in an operated position.

A first aerosol cap assembly is shown in FIGS. 1, 2 and 3 and is indicated generally by reference designation 10. The cap is utilized in conjunction with a typical aerosol container or can 100. The container 100 is normally filled with a liquid product which is not shown. The liquid product is discharged by opening a valve. The valve itself is not shown since the valve construction does not form part of this invention. Discharge pressure is obtained by a propellant which may be mixed with a product or may be physically separated from the product in any well known manner. The aerosol can 100 has an upper rim 101. A dip tube 103 and a depress type actuator valve assembly which is contained in the container 100 and which is not shown in the drawing depend from the top of the container 100 and are mounted thereto by means of a cap 102. The cap 102 forms a rim on aerosol container 100. The actuator valve is operated by depressing the tube 103. Tube 103 in turn opens the valve which is spring loaded or otherwise biased to a normally closed position within the container 100.

An actuator 34 is disposed upon the top of tube 103. A typical actuator 34 includes a spray passage which directs the pressurized contents of the container outward at a substantially right angle to the axis of the tube 103. The actuator 34 also acts as a nozzle. When the actuator 34 is in a first or rest position, the valve is closed. Depression of the actuator 34 to a second position will cause the valve to open. When the valve opens, the internal pressure in the container 100 forces the liquid contents out through the actuator 34. For as long as the actuator 34 is depressed, the valve will discharge the contents of the container 100 through the actuator nozzle. When the actuator 34 is released, the valve will close and the contents will no longer spray out.

The aerosol cap 10 which is the subject of this invention is mounted on the aerosol can 100. The cap is of two piece construction comprising a cap portion and a latching portion.

The cap portion is formed of plastic as an integrally formed unit. The plastic may be any of the conventionally used plastics such as, for example, polyethylene. The cap portion includes an integrally formed cylindrical skirt 2 which fits over the upper rim 101 of the can 100 as shown in FIG. 3. The inherent resiliency of the plastic and the snug fit of the skirt 2 on rim 101 retains the cap 10 in position on the can 100. The cap 10 includes a generally cylindrical lower portion 4 extending upward from the skirt 2. The cylindrical lower portion 4 terminates in a top portion 6. Top portion 6 closes off the top of the cap 10. Top portion 6 includes an integrally formed recess having side walls 8, bottom wall 12 and end wall 14.

An actuating lever 18 is integrally formed with the cap and hinged to the lower portion 4 by means of an integrally formed hinge portion 20. The actuating lever 18 is adapted to be depressed by a human finger to discharge the contents of the can. Although the lever 18 is shown as having a plain top surface, the lever 18 may include a finger receiving recess thereon.

As best seen in FIGS. 2 and 3, a cylindrical inner wall 24 extends downward from the interior of bottom wall 12. The wall 24 is of such a diameter and length to engage the inner rim 102 of the aerosol can 100 in a snug manner. The combination of inner wall 24 and the skirt 2 assures that the cap 10 is secured onto the aerosol can 100.

Supported in wall 12 is the latching portion or assembly 30. In the illustrative embodiment, the latch assembly is similar to the spring loaded push button-pin type latching actuator often used in push button microswitches. The assembly 30 includes piston pin 31 which is captured in a body portion 32. The body portion 32 is supported in the cap 10 by wall 12. A spring 33 is positioned on top of the body portion 32 and captured at its upper end on pin 31. The spring 33 biases pin 31 to a first or normally raised position. The lower end of the pin 31 engages a top hat type of an actuator 34. The actuator 34 has a lower portion which has a tube receiving bore 36. The tube receiving bore 36 is the size such that the actuator 34 is press fit onto tube 103. A tube 38 extends from the actuator 34 to a spray outlet 40.

The actuator 34 may be integrally formed with the pin 31. Alternatively the actuator 34 may be a separate part and pin 31 has its lower end engaging the top of the actuator 34. In either instance, the spring return actuator of the actuator valve may be utilized in place of or in conjunction with the spring 33.

In operation, the actuator lever 18 is depressed causing the pin 31 to be moved to a lower position at which it is locked in place. The downward displacement of the pin 31 moves the actuator valve 34 downward which in turn carries tube 103 downward opening the valve in the aerosol can 100 and allowing the contents to discharge through the tube 38 to the outlet 40.

The aerosol container 100 will continue to discharge its contents and it is not necessary for a finger to continue to depress the actuator lever 18.

If it is desired to stop the discharge of the contents of the container 100, actuator lever 18 is again depressed. The second depression of the pin 31 downward in turn will cause the locking mechanism of the assembly 30 to disengage. When actuator lever 18 is released, the spring 33 urges it upward and the pin 31 is likewise carried upward. The actuator 36 is moved upward and the valve coupled to the tube 103 of the aerosol can 100 closes.

Thus, in operation, a single push of the lever 18 causes the aerosol container 100 to be discharged and a second push on the actuator lever 18 shuts off or stops the discharge.

Turning now to FIGS. 4, 5, 6 and 7, a second embodiment of the invention is shown in a perspective view. The operation of the cap 210 of the second embodiment is identical to that of the embodiment of FIGS. 1, 2 and 3. In the second embodiment, the cap 210 again includes a cap portion and a latch portion. Again, the cap portion is formed of plastic, typically a polyethylene.

An actuator lever 218 is integrally formed as part of the cap portion. The actuator lever 218 is hinged to the body of the cap portion by an integrally formed hinged portion 220. In this embodiment, a latching assembly 230 is supported by an integrally formed rib 270. The latching assembly 230 includes a piston pin 231. An actuator 236 is positioned immediately below the pin 231. Integrally formed with the actuator 236 is a discharge nozzle 238 which terminates in an outlet 240.

Depression of the actuator lever 218 will push the pin 231 downward whereupon the latching assembly 230 will latch pin 231 in a first lower position. In this position the actuator 236 is depressed carrying the aerosol tube 203 downward. In this position, the aerosol container valve is opened and discharge of the contents of the container 100 occurs. Because the assembly 230 latches the pin 231 in the down position, the finger may be removed. Depression of actuator lever 218 a second time causes the pin 231 to unlatch from the latched position. After the pin 231 is depressed, the spring 233 urges the pin 231 upward. The spring loaded valve in the container 100 carries the actuator 236 upward. With the pin 231 in the raised or second position, the actuator 236 likewise is free to move upward and the valve in the aerosol container closes stopping discharge of the container contents. Alternatively, the actuator 236 may be integrally formed with the pin 231 or may be connected to the pin 231 to form a one piece construction.

Figure 8:
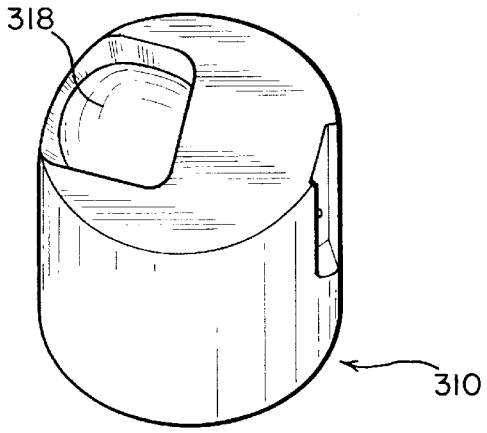
FIG. 8 is a perspective view of a third embodiment of an aerosol can cap in accordance with the invention.
Figure 9:
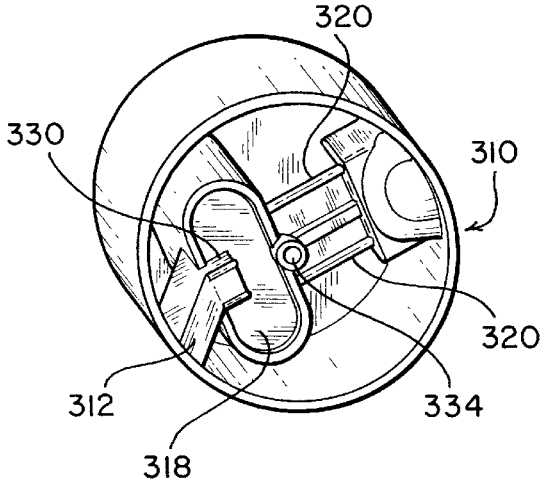
FIG. 9 is a bottom perspective view of the cap of FIG. 8.
Figure 10:
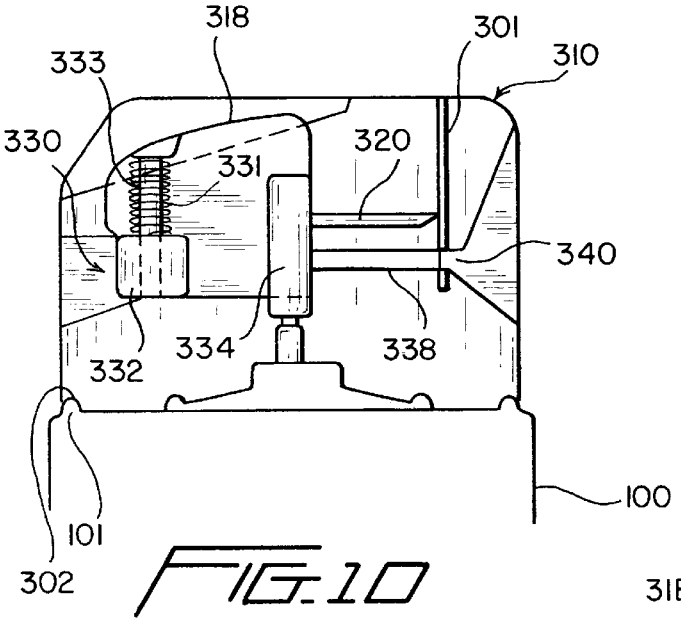
FIG. 10 is a cross sectional side view of the cap of FIG. 8.

Turning now to FIGS. 8, 9 and 10, a third embodiment of the invention is shown. In this third embodiment, a two piece construction of the cap assembly is again used. The cap 310 includes a portion 302 which engages the rim 101 of the aerosol container 100. Integrally formed with the cap 310 is an actuator lever 318. The actuator lever 318 is hinged to the cap portion 301 by means of integral hinge 320. The actuator lever 318 includes an integrally formed actuator 334. The actuator lever 318 also includes and integrally formed nozzle extension tube 338 which terminates in nozzle orifice 340. Supported in the cap 310 on a pedestal 312 is a latch mechanism 330. The latch mechanism 330 includes a piston pin 331 which is movable vertically in the latch body 332. Piston pin 331 has its upper end attached to lever 318. A spring 333 is used to provide a bias force against the pin 331. Operation of the cap 310 is similar to the operation of the prior two embodiments except that pin 331 directly operates on the lever 318 rather than on the actuator. Pin 331 is positioned so that it is at the opposite end of the lever 318 from the hinge 320, the actuator is integrally formed with the actuating lever 318. The lever 318 is notched in the vicinity of pedestal 312 so that the lever 318 may straddle pedestal 312 as it moves vertically.

Figure 11:
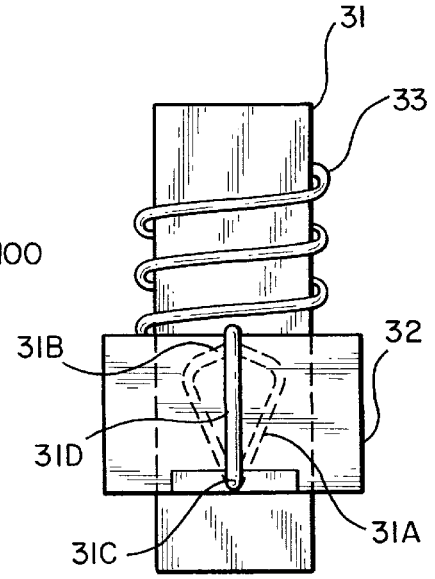
FIG. 11 is a view of a latch mechanism used in each of the embodiments.

Turning now to FIG. 11, the latching mechanism 30 of FIG. 1 is shown in further detail. The same latching mechanism is utilized in all three embodiments which have been described above. The surface of the piston pin 31 includes a rhombic shaped groove 31A. The top position 31B of the groove and the bottom position 31C of the groove define the first and second latch positions. As is known in the art, the groove includes inclined portions which are inclined such that a latch pin which rides in the groove is moved in one direction along the groove as a latch pin 31D is moved vertically up and down. The latch pin 31D is attached at one end to the body 32. The free end of the pin will ride in the groove 31A to provide the latch action.

In other embodiments of the invention,the spring 33 may be omitted and the return spring force of the aerosol container valve may be used to provide the return spring force for the latch mechanism.

As will be appreciated by those skilled in the art, various modifications may be made to the illustrative embodiments without departing from the spirit or scope of the invention.

What is claimed is:

1. A cap for an aerosol container having a depress type valve element, said cap comprising:

a cap element having tubular lower portion terminating in a female portion being shaped and dimensioned to engage the top of said aerosol container;

an actuator element shaped and dimensioned to releasably engage the top of said valve element, said actuator element being movable between a first actuator element position and a second actuator element position, said actuator element in said second actuator element position opening a valve in said aerosol container to allow discharge of the contents contained in said container, and said actuator element in said first actuator element position allowing said valve to close whereby contents of said container are not discharged;

an actuating lever said lever being coupled to said cap element via a hinge integrally formed with said cap element and said lever, said lever being coupled to said actuator element and movable between first and second lever positions;

a latch member coupled to said lever and automatically operable by said lever to latch said actuator element in said second actuator position when said lever is depressed from said lever first position and to automatically release said actuator element from said second actuator element position when said lever is depressed and released from said second lever position, whereby said actuator element returns to said first actuator element position; and said lever, said actuator element, and said latch member being in cooperative relationship such that movement of said lever from said first lever position to said second lever position carries said actuator from said first actuator element position to said second actuator element position and said latch member automatically latches said actuator in said second actuator element position, and depression of said lever when said lever is in said second lever position automatically unlatches said latch member releasing said actuator element from said second position.

2. A cap in accordance with claim 1, wherein:

said actuator element is integrally formed with said actuating lever.

3. A cap in accordance with claim 1, comprising:

a nozzle tube coupled to said actuator element.

4. A cap in accordance with claim 2, wherein:

said nozzle tube is integrally formed with said actuator element.

5. A cap in accordance with claim 4, wherein:

said nozzle tube and said actuator element are integrally formed with said cap element.

6. A cap in accordance with claim 5, wherein:

said cap element is formed of plastic.

7. A cap in accordance with claim 1, comprising:

a support member carried in said cap element, said latch member being carried by said support member.

8. A cap in accordance with claim 1, wherein:

said latch member includes a latch element, said latch element being movable between first and second positions, said latch element engaging said actuator element and carrying said actuator from said first actuator position to said second actuator position.

9. A cap in accordance with claim 8, wherein:

said latch element is integrally formed with said actuator element.

10. A latching cap for use with aerosol containers, said containers comprising a depress type valve, said cap comprising:

a cap element;

an actuator element coupled to said valve, said actuator being movable between a first actuator position wherein said valve is closed to a second actuator position wherein said valve is open; and a latch element;

said cap element including an integrally formed actuator lever, said lever being movable between a first lever position and a second lever position, said lever being coupled to said latch element, said latch element being operable such that when said lever is in said first lever position said actuator is in said first actuator position, and when said lever is in said second lever position said actuator is in said second actuator position, said latch element being coupled to said lever and moveable by said lever such that momentary depression of said lever from said first lever position to said second lever position automatically latches said lever in said second lever position.

11. A latching cap in accordance with claim 10, wherein:

said latch element being further operable such that when said lever is in said second lever position and said lever is momentarily depressed and released said latch element automatically releases said lever, whereby said lever returns to said first lever position.

12. A latching cap for use with an aerosol container, said cap comprising:

a cap element adapted to engage said container, said cap element including an actuator lever, said lever being hinged to said cap element and movable between first and second vertical positions;

an actuator disposed on said container and movable between first and second vertical positions to respectively close and open said valve; and a latch means cooperatively operative with and operated by said lever to automatically latch said lever in said second vertical position when said lever is depressed from said first vertical position and to automatically release said lever from said second vertical position when said lever is depressed and released.

* * * * *